United States Patent [19]

Townsend

[11] 4,235,692

[45] Nov. 25, 1980

[54] ELECTROLYTIC APPARATUS

[76] Inventor: Douglas W. Townsend, 35 Front St., S, Apt. 410, Mississauga, Ontario, Canada, L5H 2C6

[21] Appl. No.: 656,871

[22] Filed: Feb. 10, 1976

Related U.S. Application Data

[60] Division of Ser. No. 360,467, May 15, 1973, Pat. No. 3,979,267, which is a continuation-in-part of Ser. No. 220,245, Jan. 1, 1972, abandoned.

[51] Int. Cl.[3] ..... C25D 21/12; C25C 3/08; C25C 3/22

[52] U.S. Cl. ..... 204/228; 204/294; 204/64 R; 204/247

[58] Field of Search ..... 204/243 R, 243 M, 244, 204/245–247, 228, 64 R

[56] References Cited

U.S. PATENT DOCUMENTS

| | | | |
|---|---|---|---|
| 1,905,866 | 4/1933 | Heany | 204/243 R |
| 2,783,195 | 2/1957 | Raynes et al. | 204/243 R |
| 3,206,385 | 9/1965 | Meiklejohn et al. | 204/243 R |
| 3,282,806 | 11/1966 | Long et al. | 204/243 R |
| 3,417,002 | 12/1968 | Leary et al. | 204/243 X |

*Primary Examiner*—John H. Mack
*Assistant Examiner*—D. R. Valentine
*Attorney, Agent, or Firm*—Gilbert L. Wells

[57] ABSTRACT

It has been known that metals of groups IV-B, V-B, and VI-B of the periodic table, namely chromium, hafnium, molybdenum, niobium, tantalum, titanium, tungsten, vanadium, and zirconium and alloys thereof can be electrodeposited as dense, structurally coherent plates from a solution of the refractory metal fluoride in a molten alkali-flouride mixture in which the concentration of oxygen is reduced to and maintained at the sufficiently low level. It is shown that niobium may be plated at a lower temperature and a higher rate when the oxygen concentration is reduced to lower levels than previously attainable. The concurrent steps of electrolysis is a carbon anode, and evacuation whereby gases released from the melt at the carbon are withdrawn are shown to prepare a salt bath, and to be usable concurrently with the plating of pure niobium at a cathode, the metal depleted from the melt being replenished from a body of nobium of lesser purity maintained at a potential intermediate the potentials of the carbon anode and the niobium cathode.

2 Claims, 6 Drawing Figures

Figure 1:
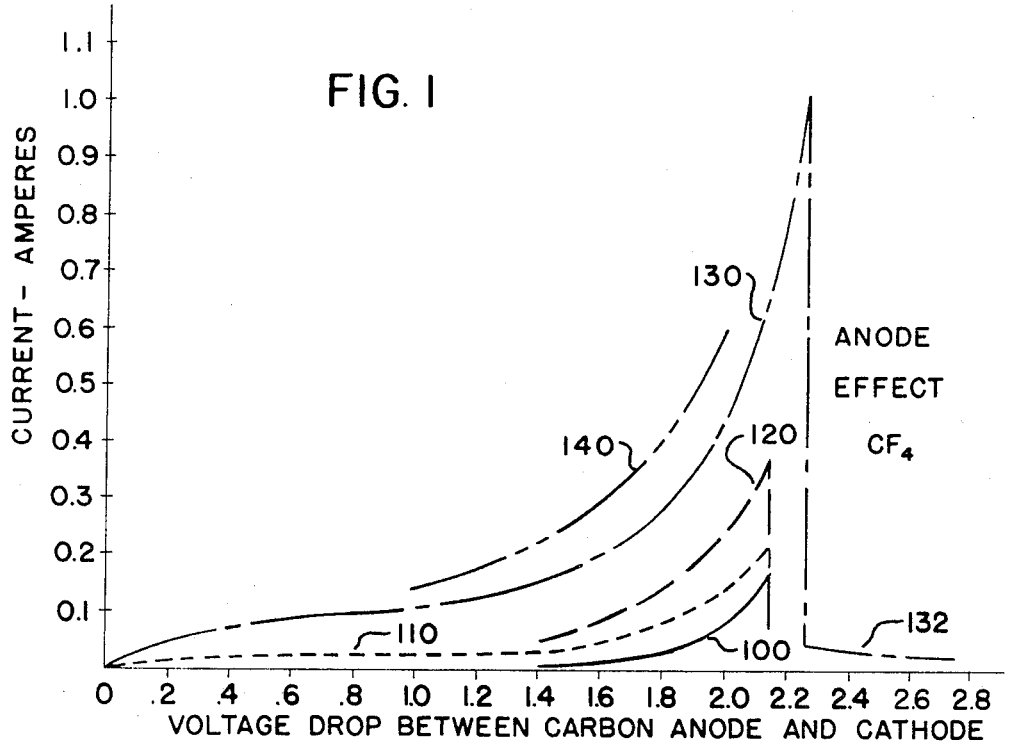

CURRENT - AMPERES
1.1
1.0
0.9
0.8
0.7
0.6
0.5
0.4
0.3
0.2
0.1
130
140
120
110
100
132
ANODE
EFFECT
$CF_4$
0 .2 .4 .6 .8 1.0 1.2 1.4 1.6 1.8 2.0 2.2 2.4 2.6 2.8
VOLTAGE DROP BETWEEN CARBON ANODE AND CATHODE

MAX. CURRENT - AMPERES
1.2
1.0
0.8
0.6
0.4
0.2
CARBON SURFACE
AREA - 2.8cm²
1 ATM.
.1
1
10
100
1000
PRESSURE - mm. Hg.

ELECTROLYTIC APPARATUS

The present application is a division of application Ser. No. 360,467 filed May 15, 1973, now U.S. Pat. No. 3,979,267 which in turn is a continuation-in-part of copending application Ser. No. 220,245 filed Jan. 1, 1972, now abandoned.

This invention relates to the electrodeposition of metals, and particularly to deposition of metals of Groups IV-B, V-B and VI-B of the periodic table. In particular the invention relates to improved means for reducing the concentration of oxygen in a fluoride melt whereby improved platings of niobium are obtained.

The prior art is well described in U.S. Pat. No. 3,444,058 to Mellors et al and an article by Mellors et al in the Journal of the Electrochemical Society, Vol. 112, No. 3, March-1965.

As pointed out by Mellors et al (see Patent, Col. four lines 6–14), it is essential that anions such as oxides, chlorides and bromides be held to a low level. To achieve the necessary low levels of oxygen, the patent describes processes in which metal to be plated is introduced into the system in its hard-to-handle hexafluoride gaseous form. The patent does not describe how the harmful anions were excluded from the melt; and whereas many of the platings obtained by the patent are described as "mechanically deformable without breaking," no such claim is made for the three examples (IV, V, and VI) involving niobium, nor are specific hardness values given for the niobium plates. The patent also fails to define limits on the "trace" of oxygen which may have remained in the metal.

The earlier work of Mellor et al at Page 269–270 reports niobium plates also having 100% of the theoretical density of niobium and with good tensile strength and ductility, but having typically 400 parts per million oxygen and in no case less than 70 parts per million oxygen; and reports "work is still in progress on the reduction of oxygen content consistently below 0.01%" (100 ppm). The patent does not report the attainment of this goal. I have discovered that when the oxygen content is reduced by my new method, that ductile plates can be produced from a melt at a lower temperature.

It is accordingly a primary object of the present invention to achieve platings of niobium with consistently less than 100 ppm of oxygen. It is a further object of the invention to achieve ductile platings of niobium by electrolysis at a lower temperature than required in the prior art. A still further object of the invention is to provide apparatus which achieves the foregoing objects without the corrosion of metal parts which accompanies prior art processes which employ sparging with hydrogen fluoride and the like.

The above objects are achieved by combining the technique of removing anions at a carbon electrode with evacuation to withdraw the resulting carbon monoxide, carbon dioxide and other gases.

Figure 2:
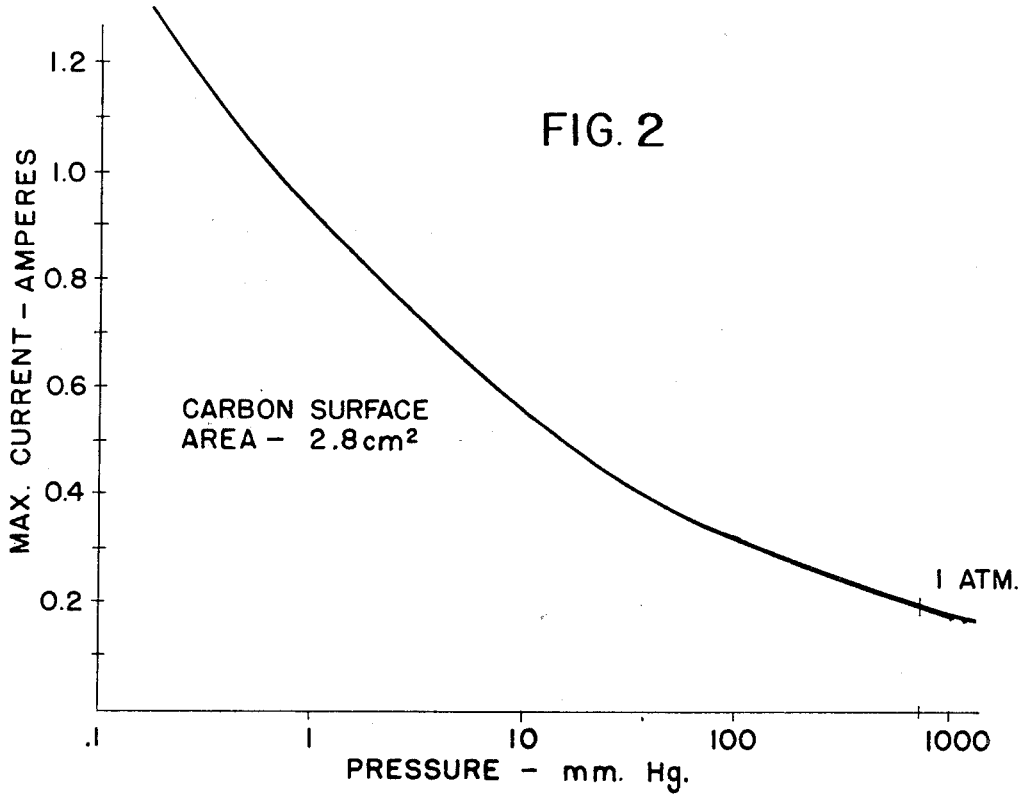
Figure 3:
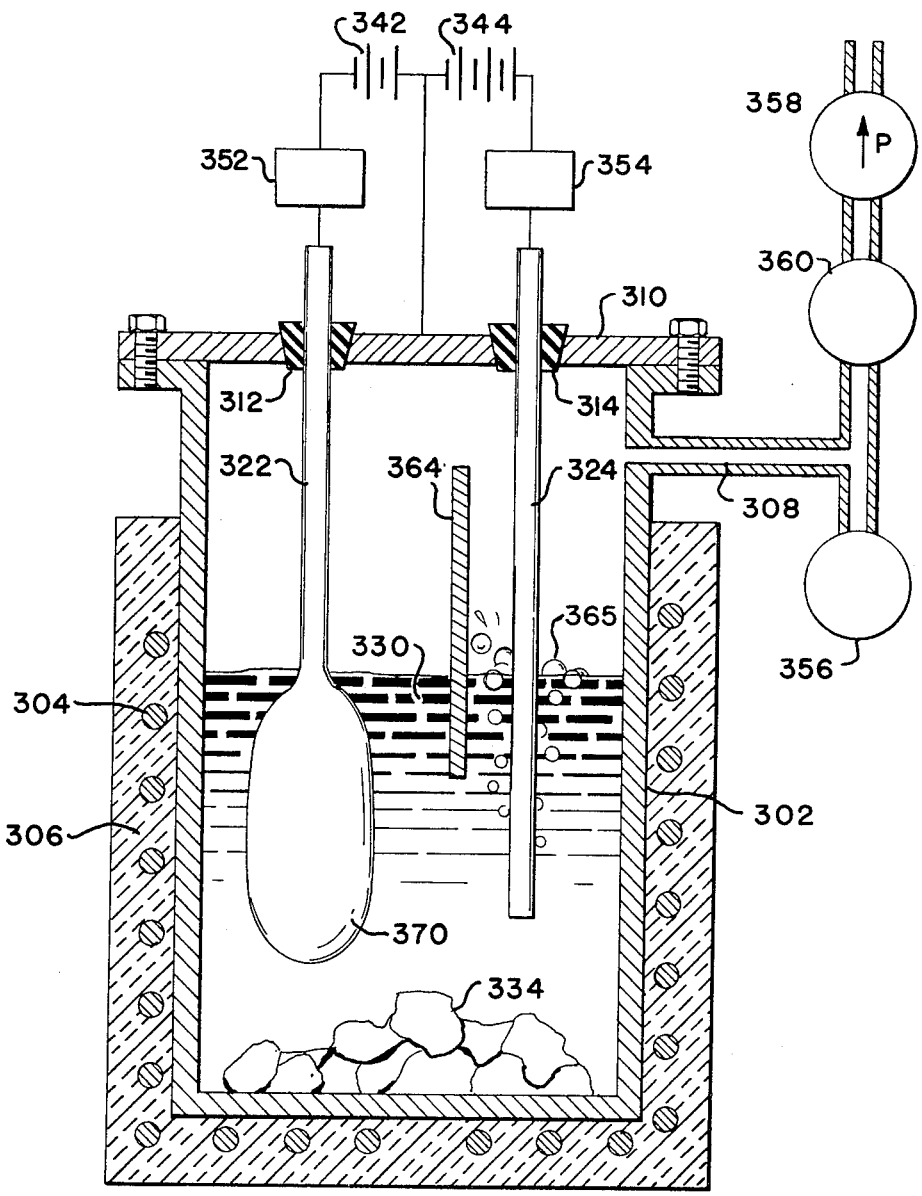
Figure 4:
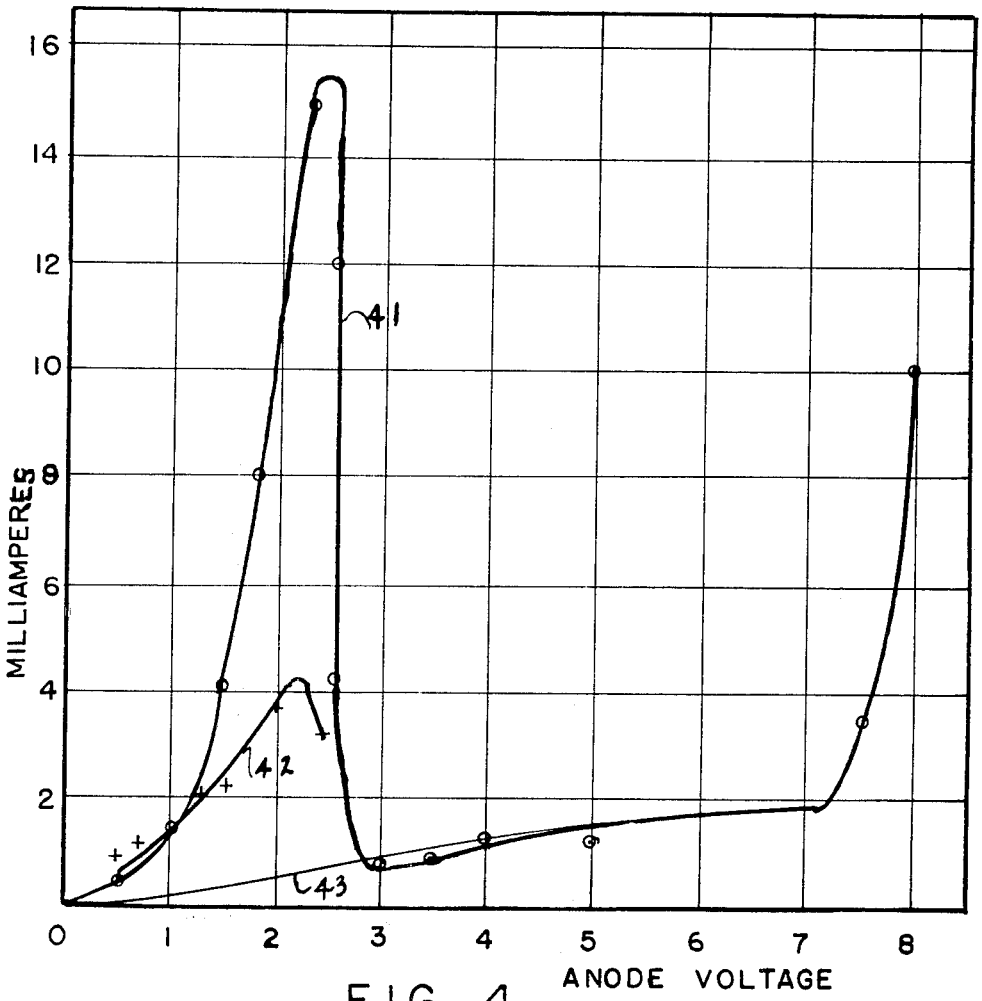
Figure 5:
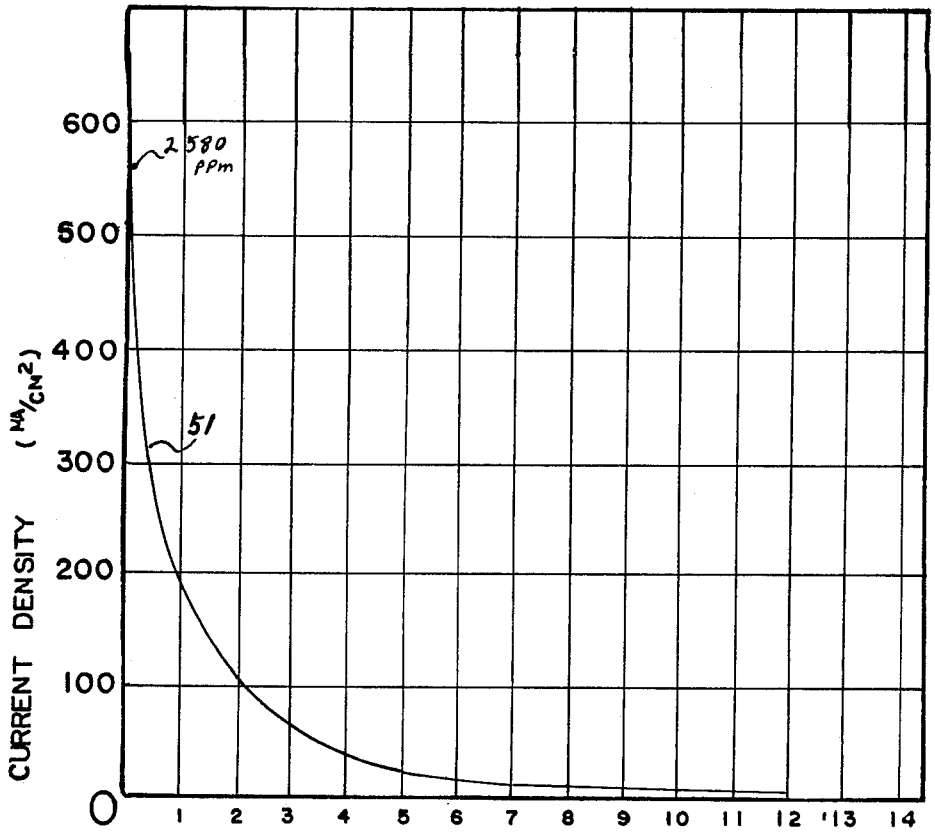
Figure 6:
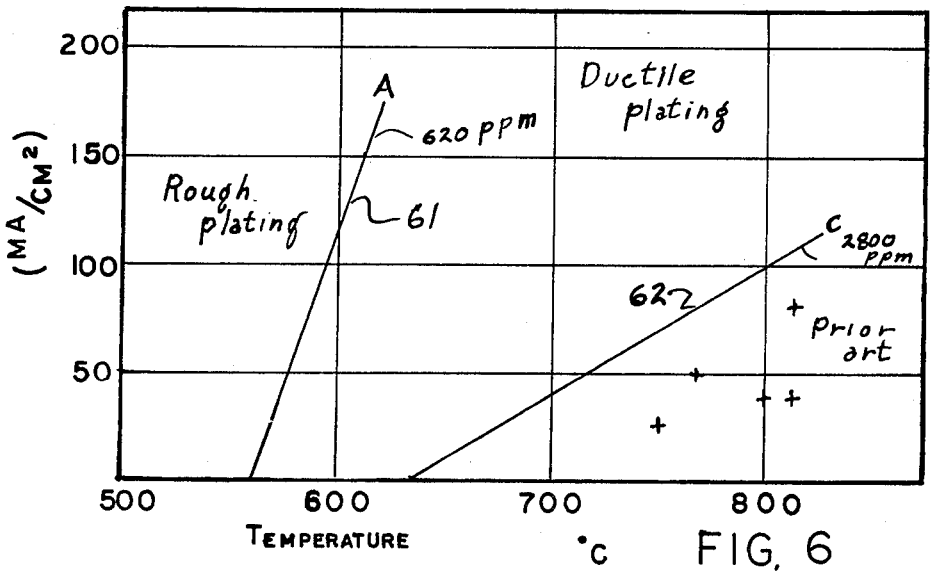

Other objects and features of the invention will in part be obvious and in part will be apprehended from the following specification read in connection with the annexed drawings of which:

FIG. 1 is a graph showing voltage-current relationships for fluoride-salt electrolysis at various pressures;

FIG. 2 is a graph showing the increase in maximum anode current achieved with reduction in ambient pressure, and FIG. 3 is a schematic diagram of an electrolytic cell for the electrorefining of niobium in accordance with the invention, FIG. 4 is a graph showing the effect of electrolysing a substantially pure FLINAK melt under vacuum and under argon pressure, the prior art, FIG. 5 is a semi-log plot showing progressive improvement of a FLINAK melt with prolonged electrolysis under vacuum, and FIG. 6 is a graph indicating the conditions needed to produce ductile niobium plating rather than rough, brittle plating.

While electrolytic processes are simple in concept, the plating of pure niobium from a fluoride melt involves many problems outside of the normal experience of electrochemists. Accordingly note should be made of the following additional references:

U.S. Pat. No. 2,828,251 issued Mar. 25, 1958 to M. E. Sibert etal (hereinafter Sibert);

An article by N. C. Cook, "Diffusion Coating Metals in Molten Fluoride Baths" Proceedings of the International Conference "Protection against Corrosion by Metal Finishing" Basel, Switzerland, Nov. 22–25, 1966 (Cook):

Paper by G. Mamantov "ELECTRODE REACTIONS IN MOLTEN FLUORIDES" in *Molten Salts,* Edited by Gleb, Mamentov, Published by Marcel Dekker, Inc. New York (Mamantov), and Paper by W. R. Grimes et al "Chemical Aspects of Molten Fluoride Reactors" 2d. Intl. Conf. on Peaceful Uses of Atomic Energy, Vienne 1958, Vol. 28 pp. 99–111 (Grimes).

As shown by Mellors, Grimes, and Mamantov, molten fluorides are of considerable importance in nuclear technology, production of aluminum and fluorine, electrochemical fluorination of organic and inorganic compounds, and for the formation of electrode deposited and diffusion coatings of refractory metals and their alloys.

Purity of the fluoride melt is important in many of these processes and various purification methods have been tried and described. Among the methods mentioned by Mamantov at page 532 are drying under high vacuum prior to melting, and pre-electrolysis. The use of the carbon anode alone is mentioned by Cook p. 153, and by Sibert Col. 4, Example I. Significantly Sibert also discloses vacuum drying of the constituents. The use of a carbon anode has been described by Reddy pp 339–340, and he describes the so-called "anode effect" which occurs when gas is produced at the carbon or graphite electrode by electrolytic decomposition of the principal halide constituent of the melt. For a fluoride melt the gas is carbon tetrafluoride. The onset of the anode effect is accompanied by an increase in the electrical resistance of the interface with an associated increase in the electric field, rendering the process unstable. The "anode is covered by myriads of luminous spark discharges—the anode overheats and and may burn up."

To prevent the onset of the anode effect, the anode potential must be kept below some critical value. Under the conditions described in the prior art, the permissible current is low. I have discovered that the rate of purification at the carbon electrode can be increased by more than 500% by pumping off the gases evolved at the anode by a suitable vacuum pump. Since the prior art also requires a closed cell to retain an inert atmosphere, evacuation is not a burdensome alternative.

FIG. 1 is a graph showing the increase in current to a carbon anode of 2.8 square centimeters area with the increase in voltage across the cell for various pressures up to a critical voltage marking the onset of the anode effect. Curve 100 is for atmospheric pressure (760 MM. Hg.): Curve 110 is for about half an atmosphere (462 mm. Hg.); curve 120 is for about one-tenth atmosphere (63 mm. Hg.); curve 130 is for somewhat less than one-thousandth of an atmosphere, and curve 140 is for a still higher vacuum (0.012–0.037 mm Hg.). As shown by curve 130, the only one traced fully, the onset of the anode effect with the production of carbon tetrafluoride gas occurs when the electrical polarization of the carbon anode is reached at about 2.2. volts. For higher voltages indicated by the portion 132 of the curve 130, the current decreases and the power dissipated as the anode increases with increased voltage; and useful electrolysis is at an end.

It is seen from the curves that evacuation has a beneficial effect, reducing the voltage drop at the anode for all rates of electrolysis.

At lower applied voltages, the less tightly bound anions such as the oxide O are released by reaction with the carbon anode to form CO and $CO_2$ gases which are withdrawn by the vacuum pump.

FIG. 2 presents some of the information of FIG. 1 in an alternative way. The curve 200 indicates the maximum attainable current for a particular anode configuration for various pressures between 0.1 mm Hg. and one atmosphere, plotted semilogarithmically. For this example the melt consisted of "FLINAK" (Sodium-Potassium-Lithium fluoride eutectic) with 0.0028% Oxygen and 4.4% niobium tetrafluoride NbF4.

FIG. 3 shows schematically how the invention may be employed to deposit plates of niobium of greater purity than the starting material. A crucible 302 of 347 stainless steel or other appropriate metal more noble than niobium with heating elements 304 and insulation 306 is provided with a vacuum connection 308 and a tight-fitting top 310.

The top is provided with a number of vacuum-seal insulators 312, 314, through which a niobium electrode 322 and a carbon electrode 324 extend downward into the melt 330. The melt may be FLINAK or other suitable fluoride electrolyte, with a starting charge of niobium tetrafluoride; and a quantity of insufficiently pure niobium metal pieces 334 which are placed in the bottom of the crucible. A means 342 is provided for applying an electrical potential to maintain the niobium cathode negative relative to the crucible and the impure niobium, and a means 344 is provided for maintaining the anode 324 at a positive potential relative to the crucible.

Control means 352 are connected in the cathode circuit to control the cathode current and control means 354 are connected in the anode circuit to control the anode current. Gauge means 356 are provided responsive to the pressure within the crucible. A vacuum pump 358 and control means 360 establish the appropriate vacuum within the crucible.

The carbon anode in operation releases a froth of bubbles 362. A baffle 364 tends to reduce spattering of the cathode 322 from the froth 365.

The amount of froth 365 produced is proportional to the anode current and inversely proportional to the pressure. It is reduced when the viscosity of the melt is reduced by increasing the temperature of the melt. In the working range, anode current increases with anode voltage and also with the level of anion impurities.

To operate, the crucible is charged and the melt brought up to operating temperature under vacuum. Then, with reduced potential between crucible and the cathode, the salt is first purified. The pressure is controlled to keep the amount of froth below a dangerous level, and the corresponding anode current and voltage are controlled to prevent onset of anode effect.

As an example, purification and plating have been accomplished with a melt having a charge in a nickel crucible consisting essentially of 14% NaF, 23.9% LiF, 54.2% KF, 7.6% NbF4, and 0.0028% Oxygen. The curves of FIG. 1 were obtained with this example.

At 700° C. niobium was plated on the cathode under an inert atmosphere of argon in accordance with the prior art. Under these conditions, the plating was observed to be brittle and imperfect and that the quality did not noticeably improve while nearly half of the niobium was plated out of the melt. The carbon anode was then introduced and the curves shown in FIG. 1 were generated. In the apparatus used, the maximum current at the highest vacuum was limited by the production of froth, and not by the anode effect.

The composition of the residual gas by mass spectrograph was determined to be: $CH_4$ 1.%, $H_2O$ 6.2%, HF 2.5%, $N_2$ 12.2%, CO 58.7%, $CO_2$ 17.1% and unknown 1.5%. At the completion of these tests, the melt was found to have the composition: 4.4% NbF4, 15% NaF, 25% LiF and 52% KF: and oxygen substantially unchanged at 0.28%.

Thereafter purification by electrolysis with the carbon anode was continued until the oxygen current at the anode for 2.1 volts and a vacuum of 0.005 mm. Hg. fell to less than one percent of the original value, indicating a reduction in the oxygen content of the melt. At 631°, niobium plated on the cathode from the melt, so depleted in oxygen, was soft, ductile and structurally sound. Because of the great difficulty in preventing oxygen contamination at these levels of purity, it has been necessary to have the oxygen content of the salts confirmed by the Oak Ridge National Laboratory using special analytical techniques. In has been established that the current is a measure of the oxygen content, as more fully explained below.

The method has general utility for the purification of fluoride salt baths, including mixtures of fluorides with chlorides and possible with bromides. The method depends upon the fact that the potential of electrochemical reaction is less for the release of oxygen than for the release of these halogens and upon the surface reaction to produce the carbon oxides, principally CO which are drawn away by the vacuum. It is not necessary to have refractory metal fluorides present; and it is preferable to purify the electrolyte without the presence of refractory metals. A range of 10 to 100 mole percentage of fluoride, the remainder substantially chloride and bromide, is recommended for practical proportions.

The method and apparatus may be used for the purification of an alkali-metal fluoride bath for the plating of any metal of groups IV-B, V-B, and VI-B of the periodic table and for similar elements of the transuranic group. It is convenient to have the refractory metal present as its fluoride in the composition so that it, rather than an alkali metal (or other metal), is released in the cathode reaction.

As the temperature of the melt is raised above its melting point, the viscosity is reduced and the vapor pressure increases. A temperature is selected which results in the minimum loss of salt from the combined effects of forming and evaporation. A temperature of 558° C. (90° C. above melting temperature) was found to be satisfactory for the example described.

The method may be used for the purification of a mixture of halides of metals in groups IV-B, V-B, and VI-B of the periodic table. In particular the method has been applied successfully to an electrolyte having the following initial compositions: Melt I 14% NaF, 23.9% LiF, 54.2% KF, and 7.6% $NbF_4$ Melt II 22.2% $CaF_2$, 1.6% $MgF_2$, 35% LiF, 37.9% NaF, 3.3% $TiF_3$ Melt III 21.2% $CaF_2$, 1.5% $MgF_2$, 33.5% LiF, 35.8 NaF, 3.0% $TiF_3$ and 5.0% $BaF_2$ None of these metal ions appear to affect the reaction at the anode that results in the liberation of oxygen as carbon oxides The only problem is that some refractory metal ions are lost to the system as a salt vapour.

In industrial practice an anode area sufficient to accomodate the desired rate of purification is selected. The process at different stages and for different purity levels is then limited by foaming, or by power supply and pump capacity. The melt can be purified as often as is necessary during a period such as weekends when plating operations may not be conducted. Quite high purity levels can be obtained with relatively inexpensive mechanical vacuum pumps.

It has been well known in the art that air must be excluded from melts of the kind herein described. Commonly in the prior art, the cells have been protected by a blanket of inert gas such as argon. In some of the prior-art patents such as U.S. Pat. No. 3,444,058 to Mellors and Senderoff there are statements such as the following appearing in that patent beginning at Col. 5, line 56:

"The electrodeposition step should be carried out in an inert, nonoxidizing atmosphere such as argon, neon, helium or the like, or under vacuum condition. If an inert gas is employed, it may be at a pressure above or below atmospheric pressure, as long as it is substantially inert with respect to the melt and the metal"

There is, of course, in nature no such thing as "vacuum condition." "Vacuum" is a term applied loosely to any level of ambient pressure less than atmospheric. It is applied to "vacuum cleaner" wherein the pressure is much higher than the pressures operable in the present invention, and to "vacuum tube" wherein the pressure is orders of magnitude lower than the present invention. It may be presumed, erroneously, that the employment of reduced pressures in accord with the present invention would be substantially the equivalent of one of the inert gases. An experiment has been conducted which demonstrates this, quite clearly, is not the case. The results are plotted in FIG. 4.

For this experiment an eutectic mixture of lithium, sodium, and potassium flourides (FLINAK) was melted under a mechanical vacuum pump pressure of about 0.2 mm. of Hg. The melt was then electrolyzed between a spectrographic graphite anode and a molten lead cathode. Curve 41 of FIG. 4 shows the dependence of current with applied voltage with this reduced pressure, indicating that an anode current of fifteen milliamperes was attained at 2.2 volts before the onset of "anode effect and the critical values is about 1 to 3 volts". Argon was then admitted to the system to atmospheric pressure; and curve 42 indicates the resulting variation of current with applied voltage taken immediately thereafter. The maximum current attainable before onset of "anode effect" under that condition is seen to be less than four milliamperes. The voltage was then reduced to two volts, safely below the potential for the onset of "anode effect", the current was then observed to decrease with the passivation of the anode until reaching the half milliampere level of curve 43. The voltage was then varied to trace curve 43 as indicated. The observed current at applied voltages of 7.5 volts and 8.0 volts reflecting the increased current associated with the evolution of $CF_4$ was the same under the three different conditions within the precision of the measurement. This demonstrates that the mechanism for the evolution of carbon oxides is different from that for $CF_4$. If it were merely the fact that reduced pressure favors any reaction resulting in an increased volume of reaction products, the evolution of $CF_4$ would also be markedly increased, which is not the case.

FIG. 5 shows the results of electrolysis of another batch of FLINAK with a carbon anode area of one square centimeter for each 91 grams of FLINAK in the same cell as used in the experiment of FIG. 4. Curve 51 indicates that the anode current decreases very quickly with time at first with the initial oxide level indicated by the top scale of 2580 parts-per-million. The rate of oxide removal is proportional to the current, and the current is proportional to the square of the concentration of oxide in the melt. As indicated, the oxide concentration was reduced to 58 parts-per-million in 48 hours indicated on the bottom scale. This level of oxide is so much lower than any reported in the prior art, that it is not known what practical applications it may have.

As shown by FIG. 6, the reduction of oxide concentration from 2800 parts-per-million representative of the prior art to 620 parts-per-million permits the production of ductile niobium plates at lower temperatures and at higher current densities. FIG. 6 is a compilation of results obtained on a total of 47 electrodeposits of niobium from molten FLINAK. Platings were performed with material having 2800 ppm oxygen at various temperatures and current densities, and the resulting plating examined. The line 61 separates the range to the right of it corresponding to conditions for ductile platings from the region to the left of it where hard and brittle platings result. Plotted in the region of ductile platings and indicated by crosses (+) are platings as reported by Mellors and Senderoff U.S. Pat. No. 3,444,058, and in their paper "The Electroforming of Refractory Metals" *Plating* 51,972 (1964).

There is nothing in their patent or paper to indicate that the oxygen level in their melts was less than about 3,000 ppm.

The chart indicates that the platings would have been impossible unless that order of purity were obtained by them.

With the melt purified to the level of 620 ppm oxygen, additional platings were performed. The line 62 separates the two regions for this improved material. With the improved purity ductile platings of niobium were attained in the region to the right of curve 62, which is to say at a much lower range of temperature and higher level of current density than for the prior art.

For systems where a metal other than niobium is being deposited at the cathode, a different cell voltage is required, less for a less reactive metal such as nickel, more for a more reactive metal.

The process may be employed in conjunction with the cladding process described by Sibert in U.S. Pat. No. 2,828,251 to produce platings of refractory metals which are diffusion alloyed to the base metal; and the process may be used for salt clean-up in connection with the "Metalliding" reactions described by Cook.

Although a bath in which the solvent is a mixture of alkali-metal fluorides as described has been satisfactory, other fluorides may be used within the spirit of the invention. As pointed out by Senderoff, U.S. Pat. No. 3,444,058, column 5, line 4, the fluoride of any metal higher in the electromotive series may be used. These include the alkaline earth metals of Group II-A and some of the metals in the Lanthanum and Actinium series.

Likewise the apparatus and method of the invention may be employed to deposit various alloys of the Group IV-B, V-B, and VI-B elements and others as described in the above-mentioned patent to Mellors et al. This may be accomplished by introducing into the melt the respective fluorides of the materials required to make the desired alloys or compounds, or by employing secondary anodes of the desired materials. By controlling the initial composition, and the contribution from each secondary anode to the cathode current, the composition of the plating is controlled.

In the description above the anode has been described as "carbon", and carbon in the form of compacted sticks of the kind used for spectroscopic electrodes has been the preferred material. It will be obvious that graphite or a mixture of carbon and graphite may be used. Also the anode might be in the form of a carbon crucible or carbon retained in a basket or grid of a suitable material, insoluble in the melt. All of these variations may be regarded as comprised essentially of carbon.

It is known that chlorides may be mixed in some proportions with fluorides in plating melts. It is known to drive oxides out of chloride melts with HCL. Accordingly the purification by electrolysis with carbon anode under vacuum is not particularly valuable in chloride melts. However, when there is a substantial fluoride content, the method is the preferred means to obtain extremely low oxide content. These melts may be regarded as comprised essentially of fluorides, and will contain at least 10% fluoride on a molar basis.

The invention provides for improved plating of refractory metals by providing a fluoride melt with reduced oxide content compared to the prior art. The reduction of oxide by carbon anode and vacuum, moreover has the advantage that it can be incorporated into the plating cell permitting the clean-up of melts which otherwise would have to be discarded. Batch processes may therefore be converted to continuous processes with attendant improvements in production. The method of removing oxide may be applied to any prior-art plating system which does not contain volatile constituents.

Specifically the invention comprehends improvements on the invention claimed by Mellors et al.

It will thus be seen that the objects set forth above, among those made apparent from the preceding description, are efficiently attained. Since certain changes may be made in carrying out the above process and in the constructions set forth without departing from the scope of the invention, it is intended that all matter contained in the above description or shown in the accompanying drawing shall be interpreted as illustrative and not in a limiting sense.

I claim:

1. Electroplating apparatus comprising:

(a) a crucible for maintaining a melt consisting essentially of at least one fluoride selected from the group consisting of alkali metal fluorides and alkaline earth metals fluorides above its melting temperature;

(b) said crucible being enclosed and adapted to sustain a vacuum over said melt;

(c) an anode comprised essentially of carbon disposed within said crucible in contact with said melt;

(d) a cathode consisting essentially of metal to be deposited within said crucible in contact with said melt;

(e) first electrical means for maintaining a positive electrical potential of about 1 to 3 volts on said anode relative to said cathode;

(f) control means providing a substantially constant potential difference between said anode and said cathode keeping said potential between 1 and 3 volts;

(g) second electrical means for maintaining a negative electrical potential on said cathode relative to said anode, whereby said metal to be deposited is plated on said cathode; and (h) second control means to control said negative potential and to control the rate at which said metal is deposited.

2. Apparatus as defined by claim 1, wherein said metal to be deposited is niobium.

* * * * *